US006854139B2

(12) United States Patent
Lamy

(10) Patent No.: US 6,854,139 B2
(45) Date of Patent: Feb. 15, 2005

(54) BED COVERING FASTENING SYSTEM

(76) Inventor: Sheila Lamy, 2024-34th Avenue SW, Calgary AB (CA), T2T 2C3

( * ) Notice: Subject to any disclaimer, the term of this patent is extended or adjusted under 35 U.S.C. 154(b) by 0 days.

(21) Appl. No.: 10/406,187

(22) Filed: Apr. 4, 2003

(65) Prior Publication Data

US 2004/0016055 A1 Jan. 29, 2004

Related U.S. Application Data

(63) Continuation-in-part of application No. 10/206,755, filed on Jul. 26, 2002, now abandoned.

(51) Int. Cl.[7] ..... A47G 9/04

(52) U.S. Cl. ..... 5/485; 5/482; 5/493; 5/658

(58) Field of Search ..... 5/482, 485, 493, 5/494, 496, 498, 502, 694; 24/72.5, 459, 462, 114.12, DIG. 41

(56) References Cited

U.S. PATENT DOCUMENTS

| | | | | | |
|---|---|---|---|---|---|
| 2,024,050 | A | * | 12/1935 | May | 24/72.5 |
| 2,763,875 | A | * | 9/1956 | Piontkowski | 5/493 |
| 3,392,729 | A | * | 7/1968 | Lenoir | 606/234 |
| 3,824,640 | A | | 7/1974 | Golden | |
| 3,967,666 | A | * | 7/1976 | Farrar | 383/7 |
| 4,175,305 | A | * | 11/1979 | Gillis | 24/459 |
| 4,235,350 | A | * | 11/1980 | Valentino | 220/495.1 |
| 4,442,558 | A | | 4/1984 | Alexander | |
| 4,658,454 | A | | 4/1987 | Potter | |
| 4,688,286 | A | | 8/1987 | Miker, Jr. | |
| 4,702,443 | A | * | 10/1987 | Callaway | 248/51 |
| 4,754,509 | A | | 7/1988 | Pollard | |
| 4,899,407 | A | | 2/1990 | McCue | |
| 5,208,926 | A | * | 5/1993 | Stackhouse | 5/482 |
| 5,279,009 | A | * | 1/1994 | Putka, Jr. | 5/485 |
| 5,321,862 | A | * | 6/1994 | Campbell | 5/482 |
| 5,438,719 | A | | 8/1995 | Anthony | |
| 5,737,785 | A | | 4/1998 | Casey | |
| 5,758,972 | A | * | 6/1998 | Mack et al. | 5/503.1 |
| 5,802,643 | A | | 9/1998 | Sloot | |
| 5,920,931 | A | | 7/1999 | Zuehlke et al. | |
| 5,996,147 | A | | 12/1999 | Trimble | |
| 6,061,849 | A | | 5/2000 | Seals | |
| 6,089,219 | A | * | 7/2000 | Kodera et al. | 126/39 R |
| 6,134,730 | A | | 10/2000 | Evanson | |
| 6,148,458 | A | | 11/2000 | Hires | |
| 6,178,574 | B1 | | 1/2001 | Stromatt et al. | |
| 6,199,232 | B1 | * | 3/2001 | Kocivar | 5/502 |
| 6,233,763 | B1 | | 5/2001 | Spaan | |
| 6,237,171 | B1 | | 5/2001 | Allen | |
| 6,286,162 | B1 | | 9/2001 | Huart | |
| 6,292,963 | B1 | * | 9/2001 | Couture | 5/503.1 |

* cited by examiner

*Primary Examiner*—Michael Trettel
(74) *Attorney, Agent, or Firm*—Bennett Jones LLP

(57) ABSTRACT

A bed covering fastening system is disclosed that provides for removable attachment of items such as storage pockets to a bed covering. The system includes a two part-fastener, one part of which is integral with a bed covering and the other part of which is integral with an item to be attached to the bed covering. The fastener part integral with the bed covering is positioned so that that attached items will hang down along the side or end of a bed. There may be a number of fastener parts positioned in a spaced apart configuration around the bed covering so that an item may be attached to various locations on the bed covering and a number of items may be so attached. A reinforcing band may also be included on the bed covering to prevent tearing of the bed covering upon removal of the item. The invention also contemplates that the item may be attached to a top covering, which may be in turn be partly attached to a bottom covering. Also disclosed is a bed covering fastener system for attaching an item to plural bed coverings, where the system includes an item to be attached to a bed covering, a female fastener part, a male-female combination fastener part, and a male fastener part. Either the male or female fastener part is integral with the item. The fastener parts are adapted by adequate inter-connection spacing for receiving between each pair thereof, one of the bed coverings for mutual snap-together engagement, whereby the item is attachable on a side of a bed in a selected position on one of the bed coverings.

39 Claims, 7 Drawing Sheets

BED COVERING FASTENING SYSTEM

CROSS REFERENCE TO RELATED APPLICATIONS

This application is a continuation-in-part of applicant's earlier application Ser. No. 10/206,755, filed Jul. 26, 2002 (now abandoned).

FIELD OF THE INVENTION

This invention relates to fastening systems and particularly to fastening systems for removeably attaching items such as a storage pocket to a bed covering.

BACKGROUND OF THE INVENTION

It is frequently desired to store certain items close to a bedside. Such items include glasses, books, remote controls, medicine, toys, and flashlights. Nightstands or shelves are commonly used for storing bedside items; however, they do not always provide an adequate or convenient storage system. For instance, it may be difficult to reach items when lying in bed, or the items may be in a cluttered state. Nightstands or shelves may also take up a considerable amount of space, which is of concern when a bedroom is small.

Bedside storage systems that hang along the side or end of a bed are an alternative solution to storing bedside items.

U.S. Pat. No. 4,235,350 discloses a bedside container that hangs on a bed side rail of a hospital bed. The container is a rigid plastic box that is open on top and has a pair of straps snap-attached to the box for being suspended around the bed side rail. This container, however, could not be used with beds that do not have a side rail.

U.S. Pat. No. 5,279,009 discloses an integrated bed sheet and pocket, wherein the pocket is affixed to the outer surface of the sheet. U.S. Pat. No. 6,178,574 describes a bed sheet with a pocket that is made by forming a hidden pocket located between the bed sheet and a mattress. These arrangements are limited in that the pocket cannot be removed from the bed sheet. Consequently, all of the items stored in the pocket must be removed prior to washing the sheet. Furthermore, the pocket is positioned at a fixed location, which location may not be convenient for the user. In the case of the '574 patent, the size of the pocket is also limited to the height of the mattress, therefore the pocket may not fit some items that the user may wish to store.

U.S. Pat. No. 5,758,972 discloses a suspendable container having a flap that is inserted between a top mattress and support structure. The container is held in place by hook and loop fasteners that are affixed to facing surfaces of the mattress support and the flap, as well as by the weight of the mattress on the flap. This arrangement is not convenient in that the mattress must be lifted up to attach or remove the container from the bed. Furthermore, when it is desired to place the container at a different location, the user must place another fastener on the support structure. Also, the size of the pocket is limited to the distance between the top of the support structure and the floor.

U.S. Pat. No. 6,292,963 discloses a pocket that is removably attached to a strap, which is in turn attached to a garter type fastener. The pocket is connected to the bed covering by clamping the bedcovering between a keyhole aperture and a locking tongue member of the fastener. This arrangement is relatively complicated.

As such, there is a need for a bedside storage system that overcomes at least some of the disadvantages of the prior art.

SUMMARY OF THE INVENTION

The present invention provides an improved bed covering fastening system for attaching items to a bed covering.

The present invention accomplishes this by providing a bed covering fastening system, comprising: a bed covering; an item to be attached to the bed covering; and a fastener for removably attaching the item to the bed covering, the fastener including a bed covering fastener part integral with the bed covering and a item fastener part integral with the item, the bed covering fastener part and the item fastener part being cooperating to permit releasable interconnection.

The bed covering fastening system is suitable for attachment of any item to any type of bed covering, such as a fitted sheet, top sheet, blanket, comforter, duvet or bed spread. While the invention contemplates that a variety of items, such as other bed coverings, may be attached to a bed covering, it is particularly useful for attaching storage pockets to a bed covering.

Any type of suitable fasteners may be used, such as snaps, buttons, hook and loop fasteners (e.g., Velcro®), ties, zippers, or hooks. A plurality of bed covering fastener parts may be integral with the bed covering such that an item may be attached to the bed covering at various locations and/or a plurality of items may be so attached. Preferably, the bed covering fastener parts are positioned in a spaced apart configuration around part or all of the bed covering and adjacent to the edge thereof, such that when the bed covering is in use on a bed, the bed covering fastener parts are located on the side walls and/or end walls of the bed covering.

Thus, the bed covering fastening system of the present invention provides a simple, convenient and versatile bedside storage system that can be used on any type of bed.

In another embodiment of the invention, there is provided a bed covering fastening system, comprising: a bottom bed covering; a top bed covering having an inner surface and an outer surface; an item to be attached to at least one of the top bed covering and the bottom bed covering; a bottom bed covering fastener part integral with the bottom bed covering; a top bed covering inner fastener part integral with the top bed covering and exposed to the inner surface of the top bed covering; a top bed covering outer fastener part integral with the top bed covering and exposed to the outer surface of the top bed covering; and an item fastening part integral with the item, the top bed covering inner fastener part selected for releasable interconnection with the bottom bed covering fastener part, the item fastener part selected for releasable interconnection with the top bed covering outer fastener part and the bottom bed covering fastener part. Therefore, in this arrangement, in addition to having an item attached to a bed covering, a top bed covering may be attached to a bottom bed covering to hold the top bed covering in place. Preferably, a plurality of bottom bed covering fastener parts are positioned in a spaced apart configuration around the entire bottom bed covering, while a plurality of top bed covering inner and outer fastener parts are positioned in a corresponding spaced apart configuration around only a bottom portion of the top bed covering.

In yet another embodiment, the invention provides a bed covering fastening system for attaching an item to a plurality of bed coverings, the bed covering system comprising: an item to be attached; a male fastener part; a female fastener part; and a male-female combination fastener part, wherein one of the male fastener part, female fastener part, or male-female combination fastener part is integral with the item, the fastener parts adapted by adequate interconnection spacing for receiving between each pair thereof, the bed covering for mutual engagement, whereby the item is attachable on one of the bed coverings. In this manner, the bed covering fastening system does not modify the bed covering by making a fastener part integral therewith and the item, such as a storage pocket, may be attached anywhere on the bed covering. Preferable, the item is attachable on the side walls or end walls of an outermost bed covering, such as a blanket.

BRIEF DESCRIPTION OF THE DRAWINGS

A further, detailed description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
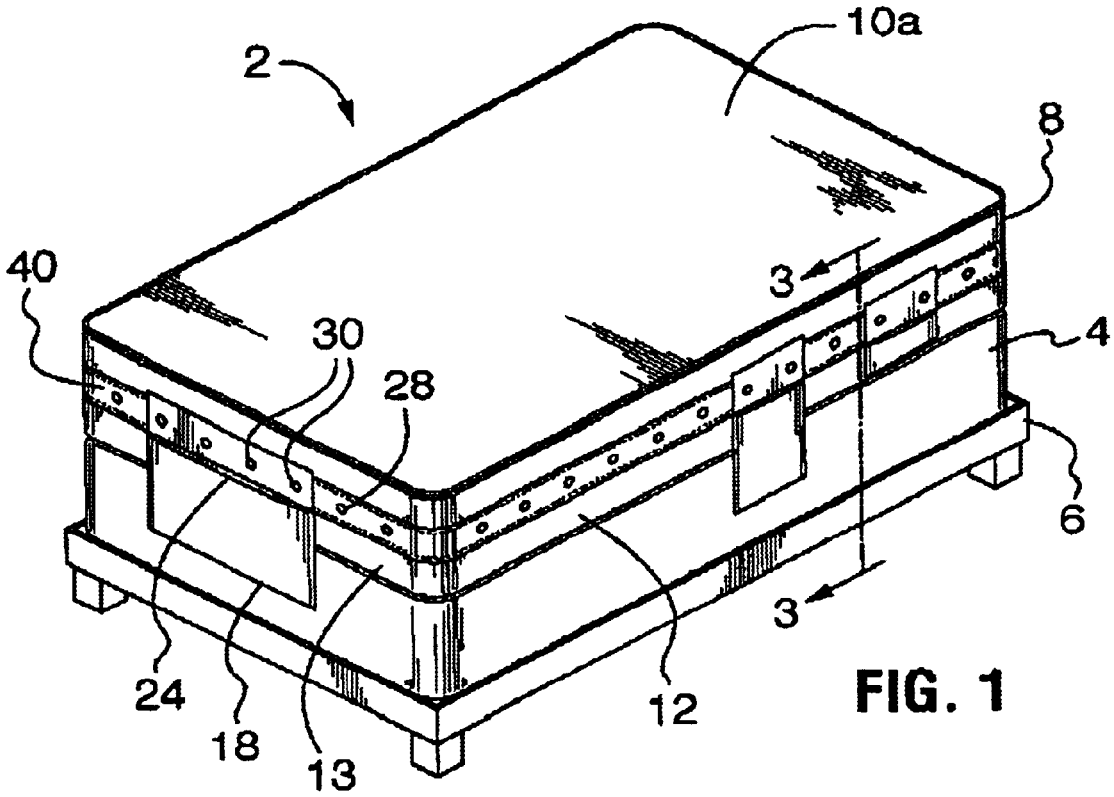
FIG. 1 is a perspective view of a bed covering fastening system in accordance with the present invention, the system in use on a bed and with storage pockets attached to a fitted sheet by snaps.
Figure 2:
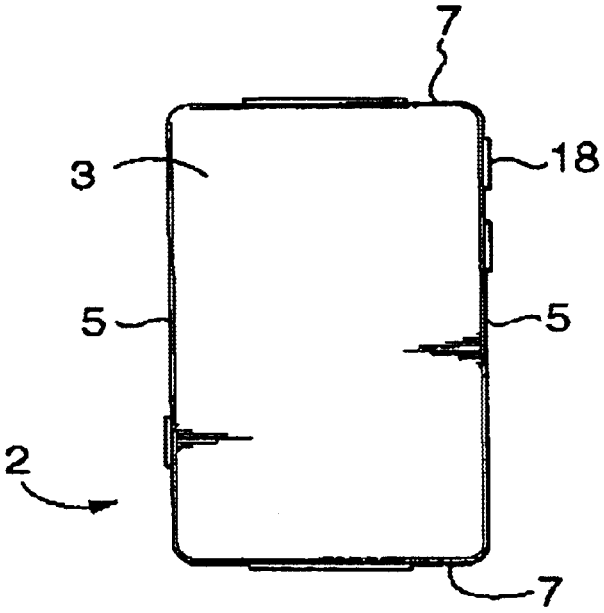
FIG. 2 is a top plan view of the bed of FIG. 1.
Figure 3A:
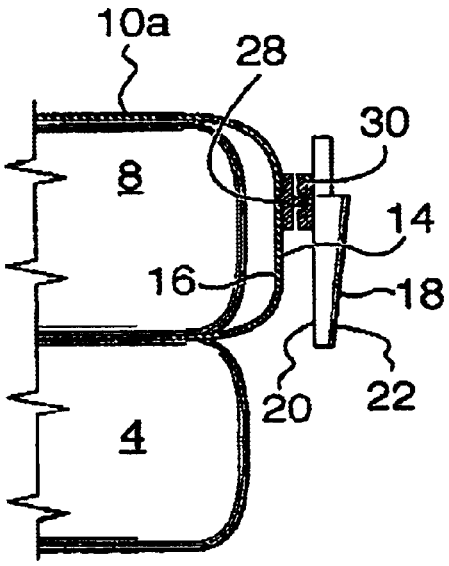
FIG. 3A is a sectional view taken along line 3—3 of FIG. 1.
Figure 3B:
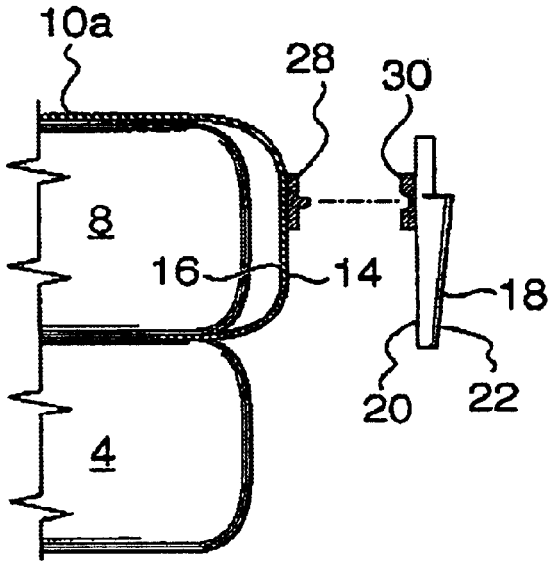
FIG. 3B is a sectional view corresponding to the view of FIG. 3A with the storage pocket detached from the fitted sheet.

Referring to the FIGS. 1–3, a bed is generally indicated at 2, the bed conventionally including a box spring 4 supported by a frame 6, and a mattress 8 disposed on the box spring 4. The bed has a top surface 3, two side walls 5 and two end walls 7. The bed may also optionally have a headboard and/or footboard (not shown). A bed covering, in this case, a fitted sheet 10*a*, is positioned on the mattress 8. Fitted sheet 10*a* is properly fit over the bed to form downwardly depending side walls 12 and end walls 13 that are generally parallel to side walls 5 and end walls 7 of the bed. The fitted sheet has an outer surface 14 facing away from the bed and an inner surface 16 facing towards the bed, as best seen in FIGS. 3A and 3B. Other bed coverings, such as a top sheet, blanket, comforter, duvet and bed spread, are properly fit in the same manner. Removeably attached to outer surface 14 of the fitted sheet are storage pockets 18, in accordance with the bed covering fastening system of the present invention.

Storage pocket 18 may be provided in a variety of appropriate sizes so as to accommodate particular items to be stored, such as glasses, books, magazines, remote controls, pens, paper, diaries, lotion, make up, dental appliances, pajamas, slippers, medication, tissue, condoms, cordless phones, flashlights, pepper spray, toys, baby monitors, soothers and other baby supplies.

The pocket may be constructed of any suitable material, such as fabric, netting, flexible sheet plastics, and hard sheet plastics. The storage pocket generally has a back side 20 and a front side 22. When the pocket is attached to the fitted sheet, the back side faces toward the bed, while the front side faces away from the bed. An access opening 24 is provided on the pocket, preferably on the front side. The access opening may also have a closure, such as a snap, button, hook, zipper, flap, and hook and loop fastener.

While the illustrated embodiment of FIGS. 1–3 shows attachment of a storage pocket to a fitted sheet, the invention contemplates attachment of any item to any bed covering using appropriate fasteners.

Storage pocket 18 is removably attached to fitted sheet 10*a* by a two-part snap fastener. One part of the snap is affixed to the fitted sheet (the fitted sheet snap part 28) and is exposed at outer surface 14 of the fitted sheet, and the other part of the snap is affixed to the pocket (the pocket snap part 30) and exposed to back side surface 20 of the pocket. The pocket is thereby attachable to the fitted sheet by interconnection of snap parts 28 and 30 and removable from the fitted sheet by disconnecting snap parts 28 and 30 from each other. While it has been shown that the fitted sheet has a male snap part and the pocket has a female snap part, this could be reversed.

Figure 4:
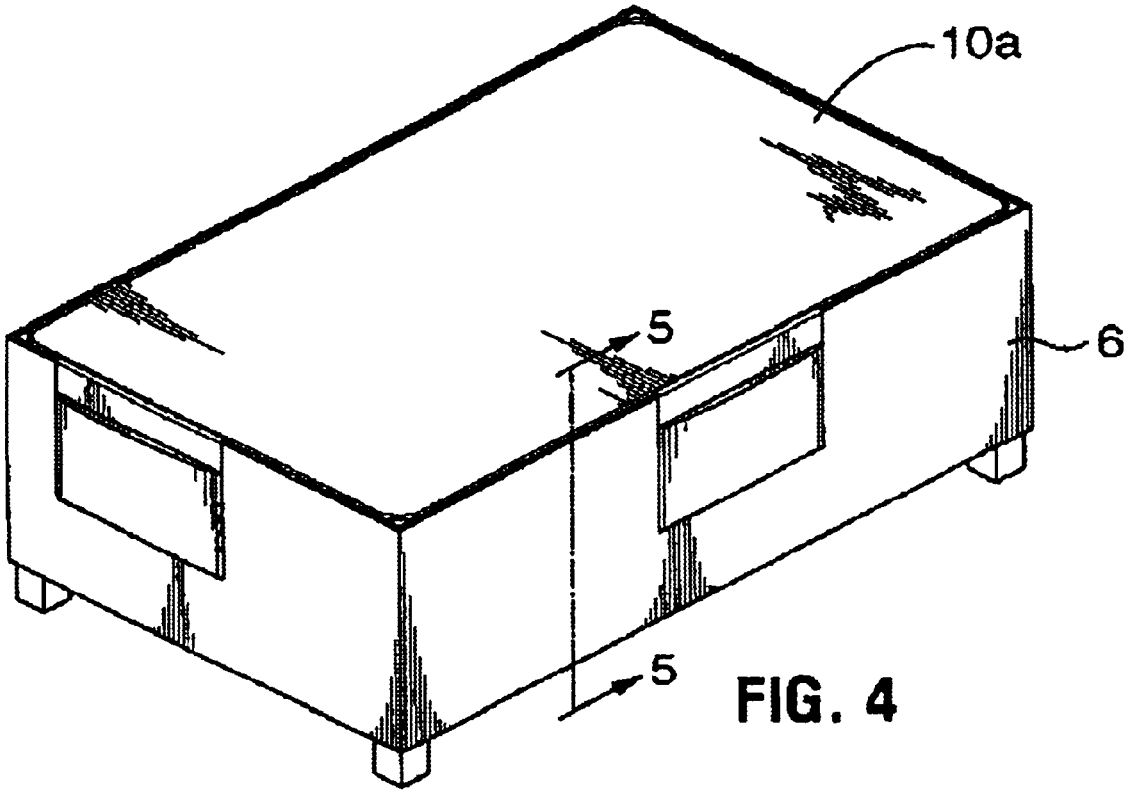
FIG. 4 is a perspective view of a bed covering fastening system in accordance with the present invention, the system in use on a bed.
Figure 5:
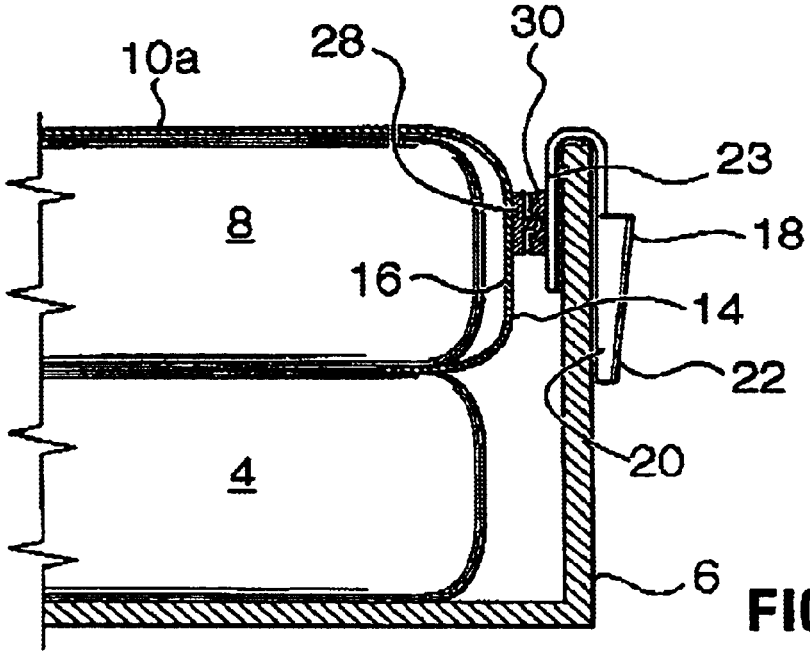
FIG. 5 is a sectional view taken along line 5—5 of FIG. 4.

The bed covering fastening system of the present invention has so far been described for use with a bed having a bottom frame only; however, the invention is suitable for use with any type of bed. As shown in FIGS. 4 and 5, the invention may be used with a bed having a frame around the side walls and end walls of the bed. In this case, pocket snap part 30 is attached to an extended top flap portion 23 of the pocket and is exposed to front side 22. When the pocket is attached to the fitted sheet, the extended top flap portion is tucked between mattress 8 and frame 6 and the pocket hangs along the outside of the frame.

Figure 6:
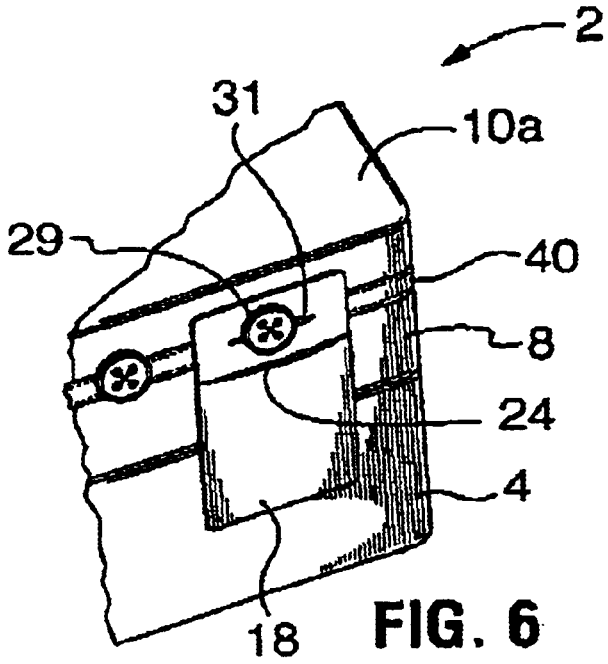
FIG. 6 is a partial perspective view of a bed covering fastening system in accordance with the present invention, the system in use on a bed and with storage pockets attached to a fitted sheet by buttons.

It is to be understood that other suitable two-part fastening systems can be used, such as buttons, zippers, hook and loop fasteners, ties, and hooks. For example, as shown in FIG. 6, the bed covering may have a button 29 affixed thereto while the pocket has a buttonhole 31 formed therein. In any case, the fastener should be selected such that the pocket is sufficiently attached to the fitted sheet to withstand the weight load of articles typically found at a bedside, while providing for easy removal of the pocket from the fitted sheet when so desired. It may be desired to remove the pocket to reposition it or to temporarily store certain items, such as condoms, contained therein elsewhere, or to separately wash the fitted sheet or the storage pocket.

In general, a fastener part is made integral with the bed covering or the storage pocket by any suitable affixing means, such as stitching, gluing, and riveting, or by virtue of the fastener part being formed from the bed covering or the pocket, such as with a hole into which hooks or buttons can be inserted. In any case, the fastener part should not be easily detached from the fitted sheet or the storage pocket with which it is integral, for example, upon removal of the storage pocket from the fitted sheet.

Figure 7:
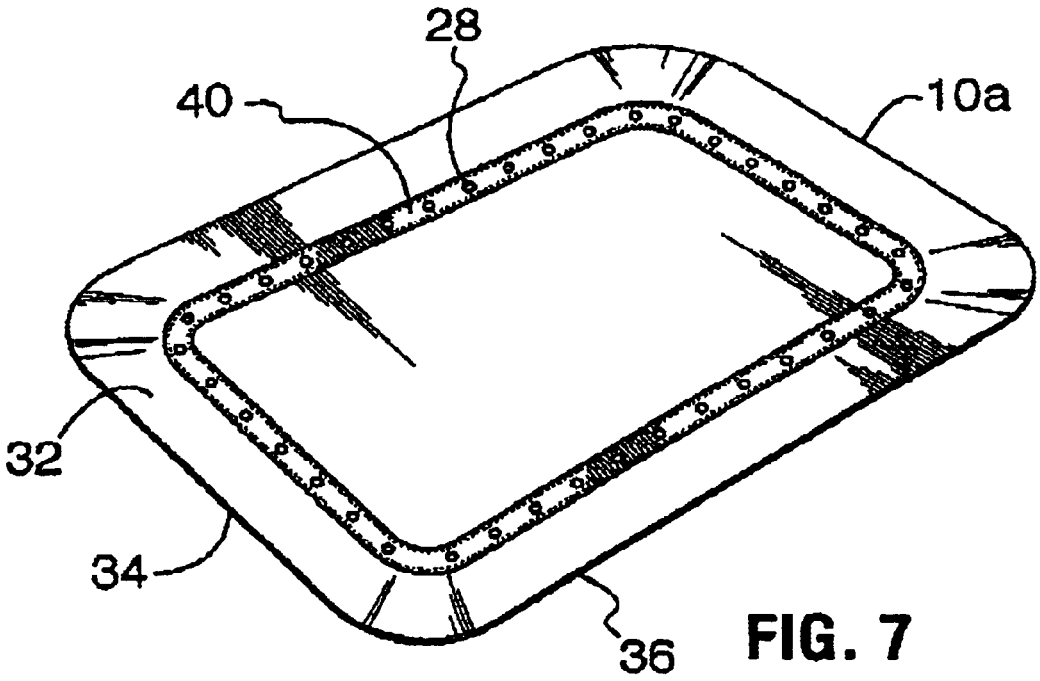
FIG. 7 is a perspective view of a fitted sheet for a bed covering fastening system in accordance with the present invention.
Figure 8:
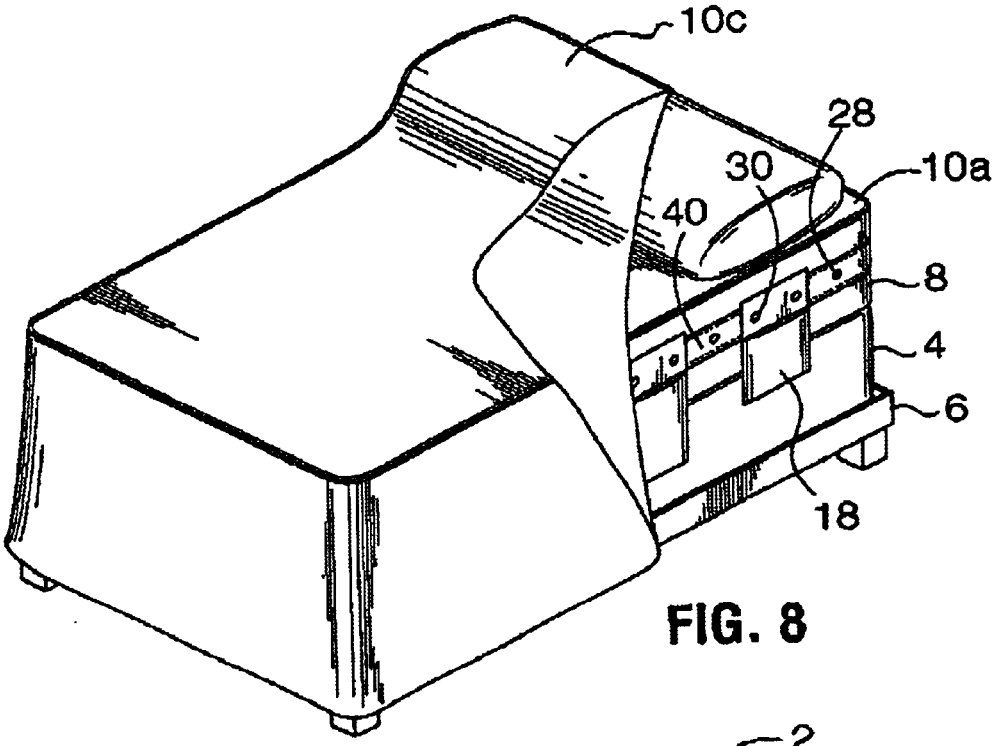
FIG. 8 is a perspective view of a bed covering fastening system of the present invention, the system in use on a bed and partially covered by a blanket.

As is known in the art, bed coverings can be formed in various configurations, but generally have a rectangular or square shape. As illustrated in FIG. 7, fitted sheet 10*a*, as with all bed coverings, has a top surface 32, a bottom surface 34, and an outer edge 36. Snap part 28 will be positioned adjacent to edge 36 of the fitted sheet such that when the fitted sheet is in use on a bed, the snap part is located on side wall 12 or end wall 13 portions of the bed covering. The attached pocket will thereby hang down beside the bed. Preferably, the fitted sheet snap part will correspond to a position adjacent to the mattress for convenient access to the pocket when the user is in bed and to allow a longer pocket to be attached to the fitted sheet without having the pocket drape on the floor. As seen in FIG. 8, the pockets provide a storage means that may be covered by a blanket 10*c*, thereby shielding the pocket and its contents from view.

Any number of snap parts may be included on the fitted sheet. Preferably, a plurality of snap parts are positioned in a spaced apart configuration (i.e., each snap part 28 is spaced a selected distance from each adjacent snap part 28) around the entire fitted sheet, as best seen in FIG. 5. This arrangement allows a pocket to be attached to the fitted sheet in various locations and also allows for several pockets to be so attached at one time. Therefore, the bed covering fastening system of the present invention provides a versatile storage system that can be used with any type of bed arrangement. For example, if the bed has a headboard or a footboard, the pockets can be placed at side walls 5 of the bed. If one side wall of the bed is against a wall, the pockets may be placed on the other side wall of the bed or on end walls 7 of the bed. Also, for storing larger items, private items (e.g., journals, condoms), or items that are not in common usage, the pockets may be placed at the end walls of the bed and out of the way, while items that are readily needed may be conveniently placed at the side walls of the bed. In addition, the pockets may also be easily switched between beds or between bed coverings when a bed is made up with new bed coverings.

When two or more snaps are used to attach the pocket to the fitted sheet, pocket snap parts 30 are spaced apart at a distance generally corresponding to the spacing of fitted sheet snap parts 28. For instance, if the fitted sheet snap parts are three inches apart, the storage pocket snap parts may be spaced three, six, and/or nine inches apart, depending on the width of the pocket 18. When Velcro® or similar types of material are used, a single large piece of Velcro may be used as the fitted sheet snap part with the same effect as a number of smaller pieces of Velcro®. While more than one type of fastener may be used on a given fitted sheet or storage pocket, it is most convenient to use one type.

The bed covering fastening system may optionally include a reinforcing band 40 that is affixed to the fitted sheet and is positioned behind fitted sheet snap parts 28. The reinforcing band can be adjacent to either the inner surface or the outer surface of the bed covering. The reinforcing band serves to increase the durability of the bed covering fastening system by reducing the likelihood that the bed covering will tear at the fastener attachment point when the storage pocket is removed or by the weight of a filled pocket. A similar reinforcing band may also be affixed to the pocket (not shown). Preferably, the reinforcing band will be made of non-shrinking material or material having a similar shrinking rate to that of the bed covering or pocket material.

Figure 9:
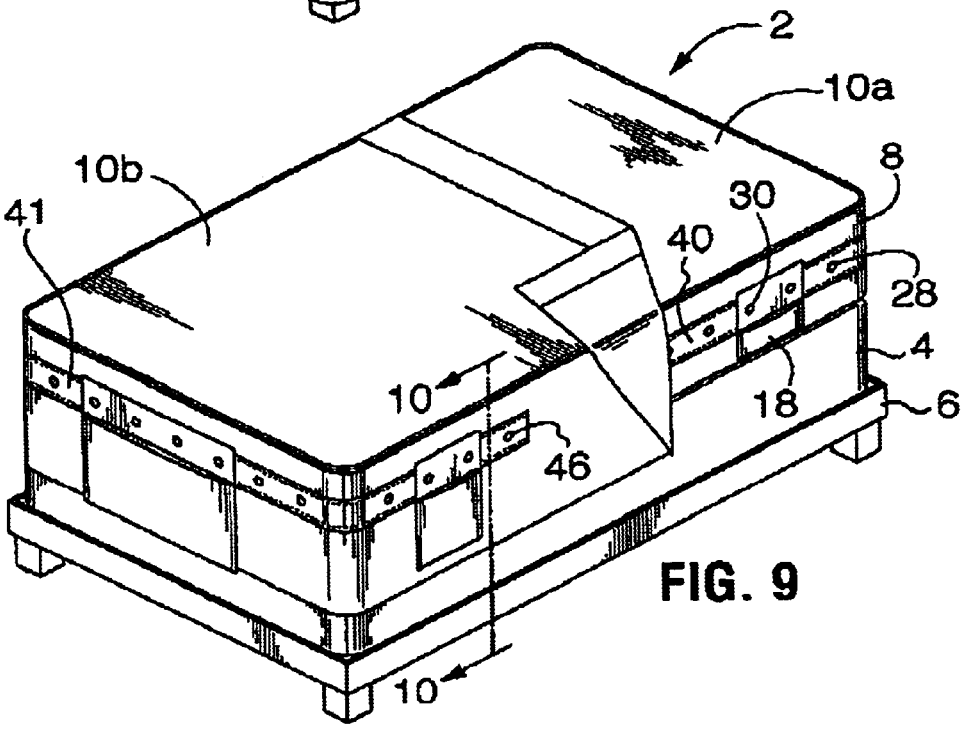
FIG. 9 is a perspective view of a bed covering fastening system in accordance with the present invention, the system in use on a bed and with a top sheet attached to a fitted sheet and with storage pockets attached to the top sheet and the fitted sheet.
Figure 10A:
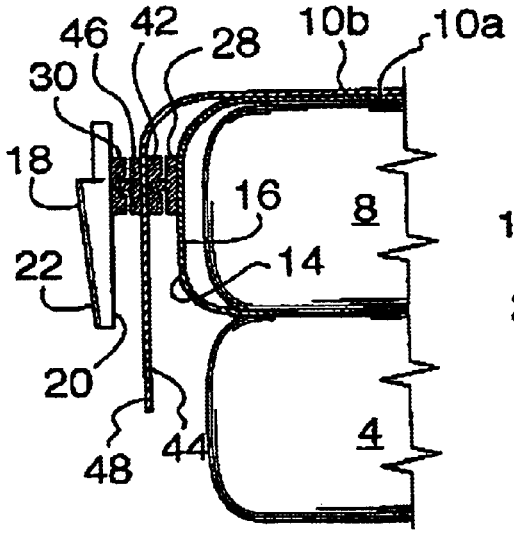
FIG. 10A is a sectional view taken along line 10—10 of FIG. 9.
Figure 10B:
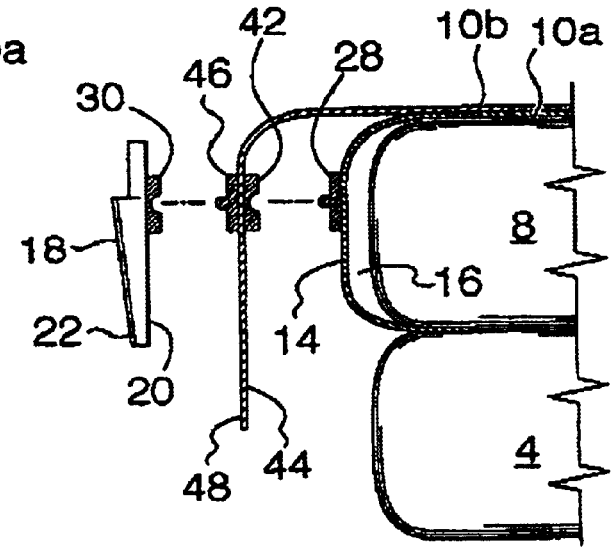
FIG. 10B is a sectional view corresponding to the view of FIG. 10A with the storage pocket detached from the top sheet and the top sheet detached from the fitted sheet.

As illustrated in FIGS. 9 and 10, the bed covering fastening system of the present invention can be used to releasably attach a top sheet 10*b* to fitted sheet 10*a* to hold the top sheet in place on a bed. A two-part snap fastener is used with one snap part 42 affixed to the top sheet and exposed to the inner/backside surface 44 of the top sheet for removable interconnection with fitted sheet snap part 28. FIGS. 9 and 10 also illustrate that a pocket may be attached to the top sheet using a snap part 46 affixed to the top sheet and exposed to the outer surface 48 of the top sheet for removable interconnection with pocket snap part 30.

It is preferable that a number of fitted sheet snap parts 28 are positioned in a spaced apart configuration around the fitted sheet, while a number of top sheet inner snap parts 42 are positioned in a corresponding spaced apart configuration around only a bottom portion of the top sheet, such as the bottom half. In this arrangement, the user may fold back the top sheet to get in and out of bed and will not disturb the pockets attached to the top sheet when doing so. At the same time, pockets may also be attached to the fitted sheet at a position where the top covering is not attached to the fitted sheet.

The top sheet may also have a reinforcing band 41 for reinforcing the attachment points of the top sheet snap parts 42 and 46, similar to that previously described for the fitted sheet.

The invention also contemplates that a three-way fastener may be used to fasten a pocket to the top sheet and the top sheet to the fitted sheet. For instance, in a three-way snap fastener, top sheet snap parts 42 and 46 are permanently attached to each other, such as by rivets, with the top sheet received therebetween. A unitary top sheet snap part is thus formed that provides for attachment to the fitted sheet on one side and to the pocket on the other side. As another example, a button may be attached to the fitted sheet while the top sheet and the pocket each form corresponding buttonholes.

While the embodiment shown in FIGS. 9 and 10 is preferred, it is to be understood that any type of bed covering is attachable to any other type of bed covering by the bed covering fastening system of the present invention. For instance, a blanket may be attached to a top sheet, or a bedspread may be attached to a blanket. In addition, any suitable two-way fastening systems, as previously described; may be used for attachment of one bed covering to another bed covering.

Figure 11:
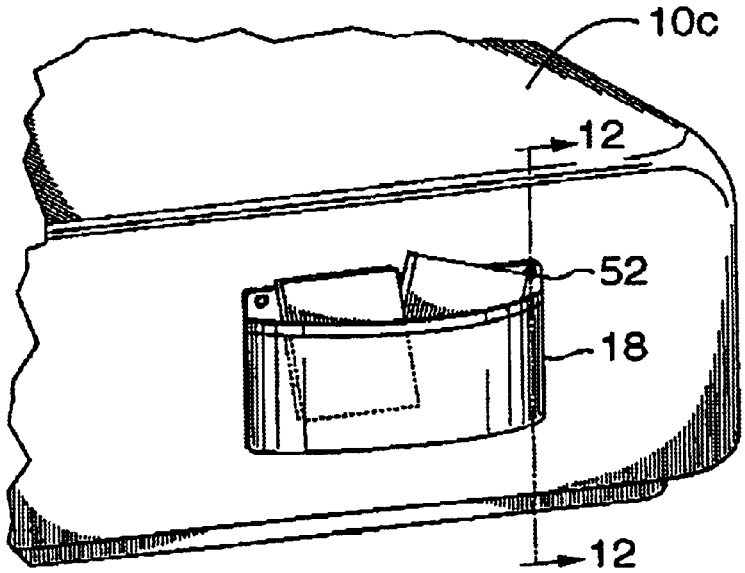
FIG. 11 is a perspective view of a bed covering fastening system in accordance with the present invention, the system in use on a bed and with a storage pocket attached to an outer blanket.
Figure 12A:
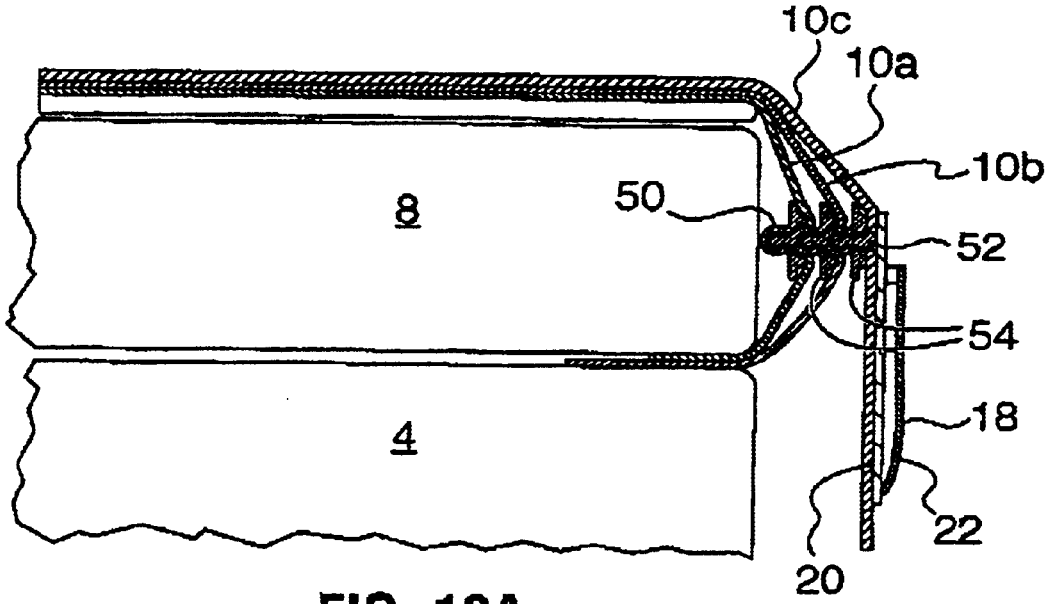
FIG. 12A is a sectional view taken along line 12—12 of FIG. 11.
Figure 12B:
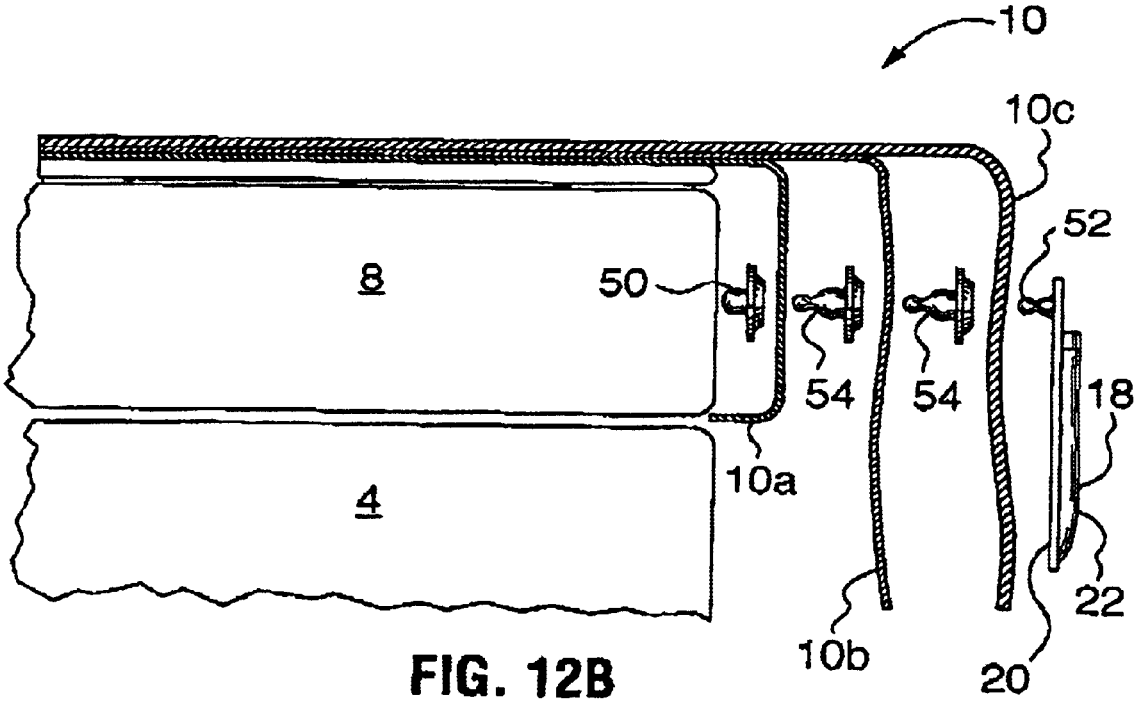
FIG. 12B is a sectional view corresponding to FIG. 12A with the storage pocket detached from the blanket and the top sheet detached from each of the blanket and the fitted sheet.

FIGS. 11 and 12 illustrate another embodiment of the present invention in which a fastener is used that does not have a fastener part integral with the bed covering. In this case, a bed covering, generally referred to as 10, is pinched between two cooperating parts of a snap fastener, one part of which is affixed to storage pocket 18. As illustrated, a female snap part 50 and a male snap part 52 are used to attach the storage pocket to a bed covering 10, preferably to an outer bed covering, in this case, the blanket 10*c*. To accomplish this, the female snap part 50 and the male snap part 52 are adapted by adequate interconnection spacing for receiving the blanket engaged between them, as shown in FIG. 10A. As shown, the pocket is affixed with the male snap part 52, but could just as easily be affixed with the female snap part 50. In this manner, the pocket is attachable anywhere on a selected position of the bed covering 10. While the fastener shown in FIGS. 11 and 12 is a snap, one skilled in the art will appreciate that other suitable fasteners may be used. For example, the fastener may be button mounted on the pocket, with a buttonhole mounted in a backup plate (not shown), where such holes are large enough to accommodate the thickness of a sheet or blanket locked within the button hole by the button (not shown).

The embodiment shown in FIGS. 11 and 12 also contemplates that plural bed coverings, in this case a fitted sheet 10*a*, top sheet 10*b*, and blanket 10*c*, may be used with a female snap part 50, a male snap part 52 and plural male-female combination snap parts 54, with either of the male or female snap parts 50, 52 affixed to the pocket. Snap parts 50, 52, 54 are adapted, by adequate interconnection spacing, for receiving between each pair thereof, one or more of the bed coverings for mutual snap-together engagement, whereby the storage pocket 18 is mountable on the side wall or end wall of a bed in a selected position, preferably, on blanket 10*c*. To enable the snap-together fastening of the male and female snap parts 50, 52 of the fastener, it is only necessary to provide enough clearance for the material thickness of the bed coverings 10 that are being used.

Although preferred embodiments of the present invention have been described in some detail hereinabove, those skilled in the art will recognize that various substitutions and modifications may be made to the invention without departing from the scope and spirit of the appended claims.

The embodiments of the invention in which an exclusive property or privilege is claimed are defined as follows:

1. A bed covering fastening system, comprising:

i) a bed covering including an edge;

ii) a storage pocket to be attached to the bed covering; and iii) a fastener for removably attaching the storage pocket to the bed covering, the fastener including a bed covering fastener part integral with the bed covering and positioned adjacent the edge of the bed covering and a item fastener part integral with the storage pocket, the bed covering fastener part and the item fastener part being cooperating to permit releasable interconnection.

2. The bed covering fastening system of claim 1 wherein the fastener is a snap, button, hook and loop fastener, tie, zipper, or hook.

3. The bed covering fastening system of claim 1 wherein the bed covering has an outer surface and the storage pocket has a back side surface, and wherein the bed covering fastener part is exposed to the outer surface of the bed covering and the item fastener part is exposed to the back side surface of the storage pocket.

4. The bed covering fastening system of claim 1 wherein the bed covering forms side walls and end walls when in use on a bed and the bed covering fastener part is positioned on at least one of the side walls and end walls.

5. The bed covering fastening system of claim 1 wherein a plurality of bed covering fastener parts are positioned in a spaced part configuration on the bed covering.

6. The bed covering fastening system of claim 1 wherein the bed covering is selected from the group consisting of a fitted sheet, top sheet, blanket, comforter, duvet, and bed spread.

7. The bed covering fastening system of claim 1 further comprising a bed covering reinforcing band positioned to reinforce the integration of the bed covering fastener part with the bed covering.

8. The bed covering fastening system of claim 1 further comprising an item reinforcing band positioned to reinforce the integration of the item fastener part with the storage pocket.

9. A bed covering pocket storage system, comprising:

i) a bed covering, the bed covering having an edge;

ii) a storage pocket;

iii) a fastener for removably fastening the item to the bed covering, the fastener including a plurality of bed covering fastener parts integral with the bed covering and a storage pocket fastener part integral with the storage pocket, the bed covering fastener parts positioned in a spaced apart configuration around the bed covering and adjacent to the edge, the bed covering fastener parts being co operable with the item fastener part to permit releasable interconnection; and iv) a reinforcing band positioned to reinforce the integration of the bed covering fastener parts to the bed covering.

10. The bed covering fastening system of claim 9 wherein the fastener is a snap, button, hook and loop fastener, tie, zipper, or hook.

11. A bed covering fastening system, comprising:

i) a bottom bed covering;

ii) a top bed covering having an inner surface and an outer surface;

iii) a storage pocket to be attached to at least one of the top bed covering and the bottom bed covering;

iv) a bottom bed covering fastener part integral with the bottom bed covering;

v) a top bed covering inner fastener part integral with the top bed covering and exposed to the inner surface of the top bed covering;

vi) a top bed covering outer fastener part integral with the top bed covering and exposed to the outer surface of the bed covering; and vii) a storage pocket fastener part integral with the storage pocket, the top bed covering inner fastener part selected for releasable interconnection with the bottom bed covering fastener part, the storage pocket fastener part selected for releasable interconnection with the top bed covering outer fastener part and the bottom bed covering fastener part.

12. The bed covering fastening system of claim 11 wherein a plurality of top bed covering inner fastener parts are positioned in a spaced apart configuration, a plurality of top outer covering fastener parts are positioned in spaced apart configuration, and a plurality of bottom covering fastener parts are positioned in spaced apart configuration, the spacing of the top covering inner fastener parts corresponding to the spacing of the bottom covering fastener parts.

13. The bed covering fastening system of claim 11 wherein the top bed covering inner fastener part and the top bed covering outer fastener part are positioned only on a bottom portion of the top bed covering.

14. A bed covering fastening system for attaching an item to a plurality of bed coverings, the bed covering system comprising:

i) an item to be attached;

ii) a male fastener part;

iii) a female fastener part; and ii) a male-female combination fastener part, wherein one of the male fastener part, female fastener part, or male-female combination fastener part is integral with the item, the fastener parts adapted by adequate interconnection spacing for receiving between each pair thereof, the bed covering for mutual engagement, whereby the item is attachable on at least one of the bed coverings.

15. The bed covering fastening system of claim 14 wherein the item is attachable on an outermost bed covering.

16. The bed covering fastening system of claim 14 wherein the item to be attached is a storage pocket.

17. A bed covering fastening system, comprising:

i) a bed covering forming side walls and end walls when in use on a bed;

ii) a storage pocket to be attached to the bed covering; and iii) a fastener for removably attaching the storage pocket to the bed covering, the fastener including a bed covering fastener part connected to the bed covering and positioned on at least one of the side walls and end walls formed by the bed covering and a storage pocket fastener part connected to the storage pocket, the bed covering fastener part and the storage pocket fastener part being cooperating to permit releasable interconnection.

18. The bed covering fastening system of claim 17 wherein the fastener is a snap, a button/button hole, a hook and loop fastener, a tie, a zipper, or a hook.

19. The bed covering fastening system of claim 17 wherein a plurality of bed covering fastener parts are positioned in a spaced apart configuration on the bed covering.

20. The bed covering fastening system of claim 17 wherein the bed covering is selected from the group consisting of a fitted sheet, a top sheet, a blanket, a comforter, a duvet, and a bed spread.

21. The bed covering fastening system of claim 17 further comprising a bed covering reinforcing band positioned to reinforce integration of the bed covering fastener part with the bed covering.

22. A bed covering fastening system, comprising:

i) a bed covering;

ii) a storage pocket to be attached to the bed covering; and iii) a fastener arrangement for removably attaching the storage pocket to the bed covering, the fastener system including a plurality of bed covering fastener parts connected to and positioned in spaced apart configuration on the bed covering and a storage pocket fastener part integral with the storage pocket, the storage pocket fastener part being co operable with at least one of the plurality of bed covering fastener parts and to permit releasable interconnection of the fastener parts.

23. The bed covering fastening system of claim 22 wherein the fastener arrangement includes snaps, buttons and button holes, hook and loop fasteners, ties, zippers, and/or hooks.

24. The bed covering fastening system of claim 22 wherein the bed covering has an edge and the plurality of bed covering fastener parts are positioned adjacent to the edge.

25. The bed covering fastening system of claim 22 wherein the bed covering forms side walls and end walls when in use on a bed and the plurality of bed covering fastener parts are positioned on at least one of the side walls and end walls.

26. The bed covering fastening system of claim 22 wherein the bed covering is selected from the group consisting of a fitted sheet, a top sheet, a blanket, a comforter, a duvet, and a bed spread.

27. The bed covering fastening system of claim 22 further comprising a bed covering reinforcing band positioned to reinforce the connection of the plurality of bed covering fastener parts with the bed covering.

28. A bed covering fastening system, comprising:

i) a bed covering;

ii) a storage pocket to be attached to the bed covering;

iii) a fastener for removably attaching the storage pocket to the bed covering, the fastener including a bed covering fastener part integral with the bed covering and a storage pocket fastener part integral with the storage pocket, the bed covering fastener part and the storage pocket fastener part being cooperating to permit releasable interconnection; and iv) a bed covering reinforcing band positioned to reinforce the integration of the bed covering fastener part with the bed covering.

29. The bed covering fastening system of claim 28 wherein the bed covering has an edge and the bed covering fastener part is positioned adjacent to the edge.

30. The bed covering fastening system of claim 28 wherein the bed covering forms side walls and end walls when in use on a bed and the bed covering fastener part is positioned on at least one of the side walls and end walls.

31. The bed covering fastening system of claim 28 wherein a plurality of bed covering fastener parts are positioned in a spaced apart configuration on the bed covering.

32. The bed covering fastening system of claim 28 wherein the bed covering is selected from the group consisting of a fitted sheet, a top sheet, a blanket, a comforter, a duvet, and a bed spread.

33. The bed covering fastening system of claim 28 further comprising a storage pocket reinforcing band positioned to reinforce the integration of the storage pocket fastener part with the storage pocket.

34. A bed covering fastening system, comprising:

i) a bed covering;

ii) a storage pocket to be attached to the bed covering;

iii) a fastener for removably attaching the storage pocket to the bed covering, the fastener including a bed covering fastener part integral with the bed covering and a storage pocket fastener part integral with the storage pocket, the bed covering fastener part and the storage pocket fastener part being cooperating to permit releasable interconnection; and iv) a storage pocket reinforcing band positioned to reinforce the integration of the storage pocket fastener part with the storage pocket.

35. The bed covering fastening system of claim 34 wherein the bed covering has an edge and the bed covering fastener part is positioned adjacent to the edge.

36. The bed covering fastening system of claim 34 wherein the bed covering forms side walls and end walls when in use on a bed and the bed covering fastener part is positioned on at least one of the side walls and end walls.

37. The bed covering fastening system of claim 34 wherein a plurality of bed covering fastener parts are positioned in a spaced apart configuration on the bed covering.

38. The bed covering fastening system of claim 34 wherein the bed covering is selected from the group consisting of a fitted sheet, a top sheet, a blanket, a comforter, a duvet, and a bed spread.

39. The bed covering fastening system of claim 34 further comprising a bed covering reinforcing band positioned to reinforce integration of the bed covering fastener part with the bed covering.

* * * * *